US012613031B2

(12) United States Patent
Farinha et al.

(10) Patent No.: US 12,613,031 B2
(45) Date of Patent: Apr. 28, 2026

(54) INFRARED RADIATION EMITTER

(71) Applicant: SOLARONICS, Armentieres (FR)

(72) Inventors: James Farinha, Strazeele (FR); Philippe Arnouts, Bailleul (FR); Nicolas Even, Vieille Chapelle (FR)

( * ) Notice: Subject to any disclaimer, the term of this patent is extended or adjusted under 35 U.S.C. 154(b) by 295 days.

(21) Appl. No.: 18/039,755

(22) PCT Filed: Nov. 25, 2021

(86) PCT No.: PCT/EP2021/083005
§ 371 (c)(1),
(2) Date: Jun. 1, 2023

(87) PCT Pub. No.: WO2022/117434
PCT Pub. Date: Jun. 9, 2022

(65) Prior Publication Data

US 2024/0003537 A1 Jan. 4, 2024

(30) Foreign Application Priority Data

Dec. 3, 2020 (FR) ..... 2012582

(51) Int. Cl.
*F23D 14/12* (2006.01)
*F23D 14/14* (2006.01)

(52) U.S. Cl.
CPC ..... *F23D 14/125* (2013.01); *F23D 14/147* (2021.05); *F23D 2203/1023* (2013.01); *F23D 2212/10* (2013.01); *F23D 2212/20* (2013.01)

(58) Field of Classification Search
CPC ..... F23D 14/125; F23D 14/147; F23D 2203/1023; F23D 2212/10; F23D 2212/20
USPC ..... 431/326
See application file for complete search history.

(56) References Cited

U.S. PATENT DOCUMENTS 3,199,572 A * 8/1965 Boulet ..... F23D 14/145 431/329
5,571,009 A * 11/1996 St.ang.lhane ..... F23D 14/145 126/41 R
6,205,789 B1 * 3/2001 Patterson ..... F23R 3/06 60/754

(Continued)

FOREIGN PATENT DOCUMENTS

CN 101225957 7/2008
CN 202521604 11/2012

(Continued)

OTHER PUBLICATIONS

English abstract of CN202521604.
English abstract of CN105393055.
English abstract of CN101225957.

*Primary Examiner* — Avinash A Savani

(57) ABSTRACT

The disclosure relates to a gas-heated infrared radiation emitter comprising at least one radiating screen, which is for example made of ceramic and/or metal, in the form of at least one plate comprising a lower main surface and an upper main surface that are distant from each other, and a plurality of through-prisms, which are preferably hollow, extending from the lower main surface to the upper main surface, each prism being defined by a polygonal base and by an axis. The prisms may be juxtaposed with one another so that their polygonal bases form a tiling of at least one portion of the lower and upper main surfaces of said plate.

20 Claims, 2 Drawing Sheets

(56) References Cited

U.S. PATENT DOCUMENTS

| | | | | |
|---|---|---|---|---|
| 6,575,736 | B1 | 6/2003 | Aust et al. | |
| 10,072,839 | B2 | 9/2018 | Even et al. | |
| 11,047,572 | B2 * | 6/2021 | Karkow | F23D 14/82 |
| 2005/0017203 | A1 | 1/2005 | Aust | |
| 2013/0273485 | A1 | 10/2013 | Lenoir et al. | |
| 2014/0248570 | A1 * | 9/2014 | Zhang | F23N 5/12<br>431/328 |
| 2015/0276220 | A1 * | 10/2015 | Karkow | F23D 14/24<br>110/297 |
| 2017/0108214 | A1 | 4/2017 | Even et al. | |

FOREIGN PATENT DOCUMENTS

| | | | |
|---|---|---|---|
| CN | 103261790 | | 8/2013 |
| CN | 105393055 | | 3/2016 |
| CN | 105917168 | | 8/2016 |
| DE | 19901145 | A1 | 7/2000 |
| FR | 1246693 | A | 11/1960 |
| GB | 905481 | A | 9/1962 |
| WO | 03069224 | A1 | 8/2003 |
| WO | 2010003904 | A1 | 1/2010 |
| WO | 2015110303 | A1 | 7/2015 |
| WO | 2017156440 | A1 | 9/2017 |

* cited by examiner

[Fig. 1]
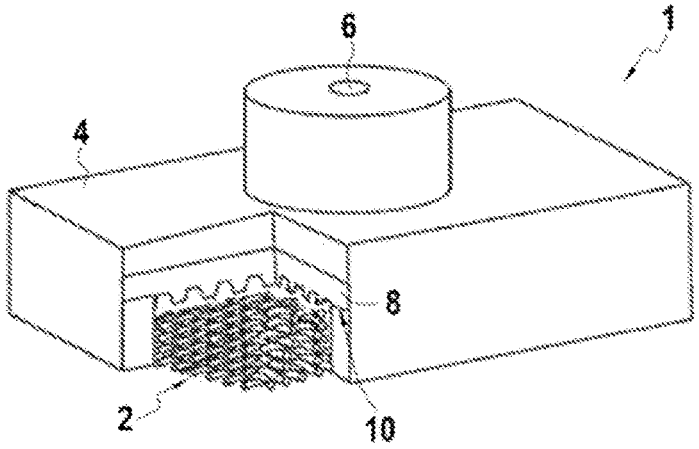
PRIOR ART
[Fig. 2]
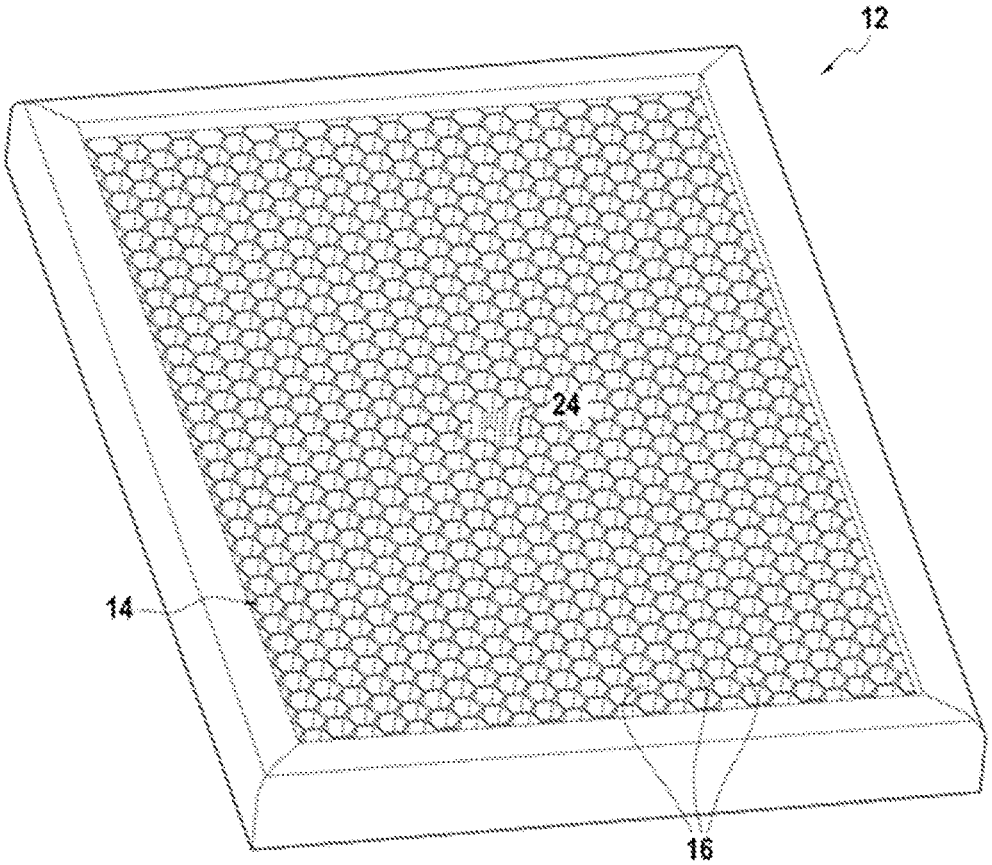

[Fig. 3]
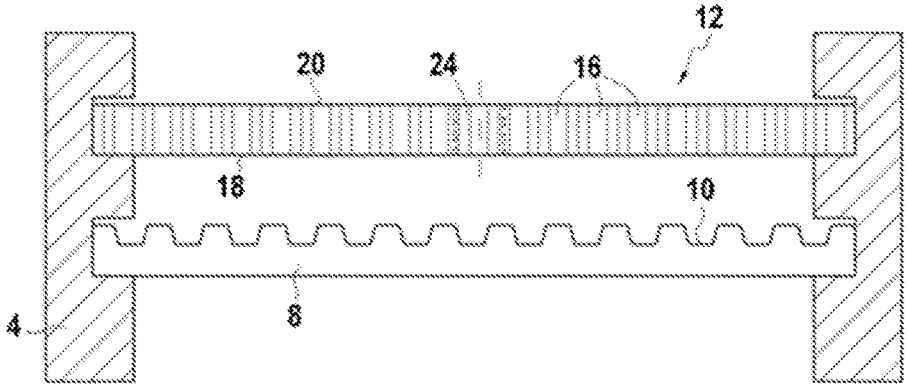
[Fig. 4]
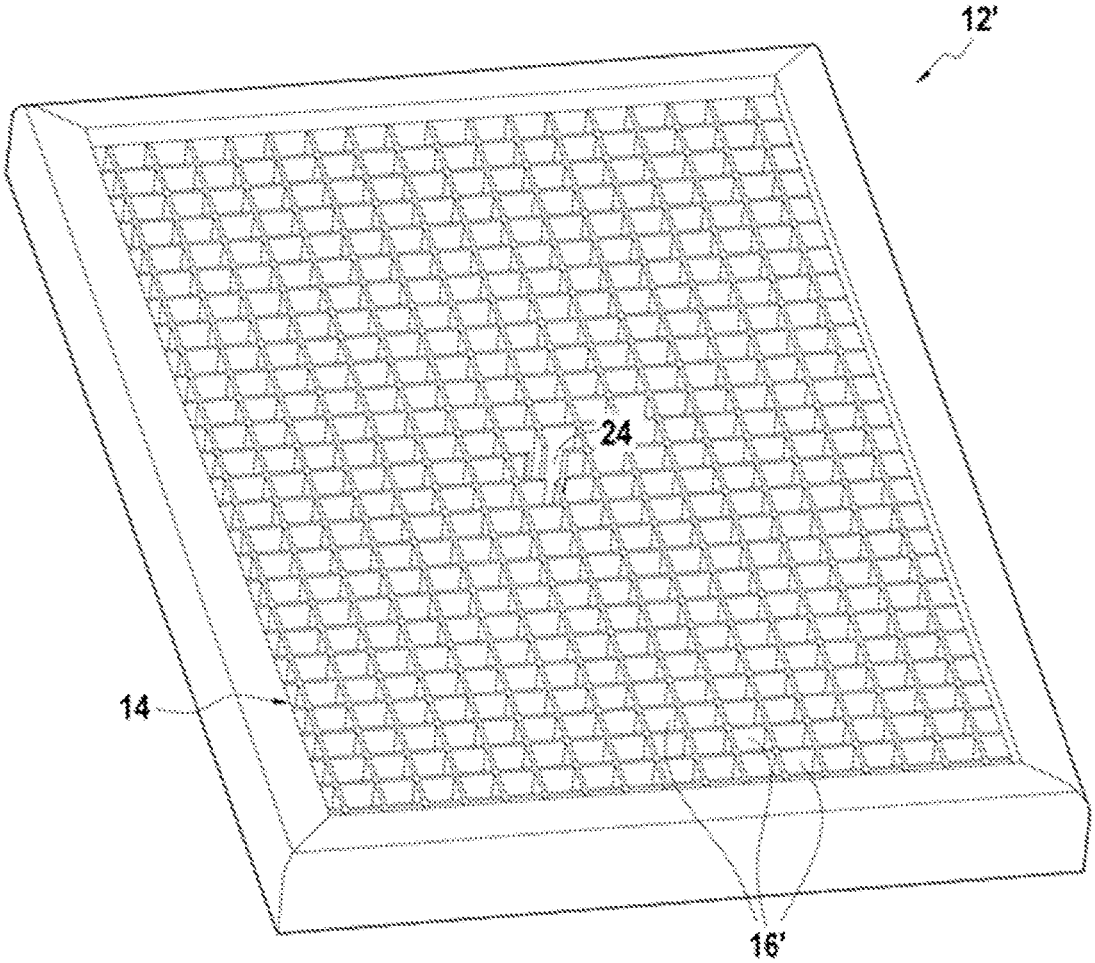

INFRARED RADIATION EMITTER

TECHNICAL FIELD

The present disclosure relates to the field of infrared radiation emitters, and in particular gas-heated emitters.

BACKGROUND

It is known to use a screen in gas-heated infrared radiation emitters. Such screens, positioned facing a burner plate, in general a perforated ceramic plate on which the gas is burnt, are intended to be heated by the combustion of the gas in order to emit infrared radiation, while allowing the circulation through them of the gases once burned.

Such screens can thus be formed by ceramic rods, mounted in parallel in a same plane, at a distance from one another. Alternatively, such screens can be formed by an assembly of metal wires that are criss-crossed or woven together.

Emitters with such screens have thus been known for a long time and have a stable and optimised operation enabling good efficiency to be obtained while limiting operating anomalies.

Screens also exist that are formed from foamed materials or materials with open pores.

It is also known to use a mesh material to form the screen of a gas-heated infrared radiation emitter. Such mesh materials can be designated as trellis-structured materials or as lattice-structured materials. In particular, such materials have a geometric spatial organisation. Hence, the structure of such materials corresponds to the repetition, in the three spatial directions, of a same geometric unit cell (mesh or cell), preferably in three dimensions. In particular, such materials can have a structure forming edges of unit cells (or meshes or cells) repeated in a three-dimensional network.

Such mesh materials have recently proved interesting for replacing traditional screens of infrared radiation emitters, in particular due to their efficiency. An infrared radiation emitter including such mesh material as a screen is described, in particular, in document WO 2017/156440.

However, the operation of the screens described above is not always satisfactory. In particular, some screens may require a warm-up time of several minutes. Others may be unstable in operation and risk shutting down unexpectedly. Finally, others may have a performance in terms of infrared radiation that is below average.

SUMMARY

The present disclosure aims to solve the various technical problems stated above. The present invention thus aims to provide a gas-heated infrared radiation emitter, having a short warm-up time, an operating stability comparable to conventional emitters and an efficiency greater than or equal to that of conventional emitters. In particular, the present disclosure aims to provide a gas-heated infrared radiation emitter with a screen formed by a specific structure that can achieve an improved operation, in particular during ignition.

Thus, according to one aspect, a gas-heated infrared radiation emitter is provided, comprising at least one radiating screen, which is for example made of ceramic and/or metal, in the form of at least one plate having:

- a lower main surface and an upper main surface that are distant from each other, and

- a plurality of through-prisms extending from the lower main surface to the upper main surface, each prism being defined by a polygonal base and by an axis, wherein the prisms are juxtaposed with one another so that their polygonal bases form a tiling of at least one portion of the lower and upper main surfaces of said plate.

The term "prism" shall mean shapes or contours delimited by two polygons, for example identical, referred to as the polygonal bases of the prism, the two polygons being connected to one another by parallelograms. The term "axis of the prism" shall mean the direction connecting together the two polygonal bases of the prism. In the case where the polygonal bases of a prism are identical and where the axis of the prism is perpendicular to the polygonal bases, in other words in the case where the prism extends perpendicularly to the main surfaces of the plate, then the polygonal bases are the cross-sections of the prism.

The prisms of the screen are through-prisms, in other words the polygonal bases are open so that the prisms define a passage, in particular for the circulation of combustion gases from the emitter. The through-prisms are therefore hollow. The through-prisms may also be designated, in the rest of the description, by the term through-channels, or hollow channels, or else by the term through-tubes, or hollow tubes.

In other words, the plate of the screen includes a plurality of through-channels, or through-tubes, the through-channels extending from the lower main surface to the upper main surface, and the through-channels having a prism geometry defined by a polygonal base and by an axis. In particular, the through-channels are juxtaposed with one another so that their polygonal bases form a tiling of at least one portion of the upper and lower main surfaces of the plate.

Thus, the screen has a specific structure formed by the juxtaposition of channels, preferably parallel to one another, the geometry of the ends of which enable a tiling of at least one portion of the two main surfaces of the screen. Thus a screen is obtained, for which the sum of the through-surfaces of the channels, or prisms, is optimised relative to the total surface of the screen and relative to the dimension of the prisms. The various channels of the screen are the separated from one another by the walls of said channels, in other words by the parallelograms of the prisms, which leads to a reduced quantity of material. In other words, each portion of channel wall forms part of the wall of two adjacent channels, which are separated from one another by said portion of common wall.

In particular, it has been observed that such structures, in the role of a gas emitter screen, can rapidly reach the operating temperature while having high operating stability and durability over time. Such structures can, in particular, reach their nominal operating temperature in half the time taken by conventional screens, or else in much less time.

Preferably, the prism bases are all hexagonal, triangular or square, and preferably are all identical.

The surface of the screen is thus tiled by the same geometric shape, or polygon, according to a tiling which may or may not be regular, depending on whether or not the polygons are all the same size.

In the particular case of hexagonal bases, a screen is then obtained with a honeycomb structure, in which the "cells" are formed by the through-prisms. The structure extends over at least one portion of the surface of the screen, preferably over the entire surface of the screen, and the through-prisms enable the circulation of combustion gases through the screen.

For each through-prism, the axis can be perpendicular to one or other of the polygonal bases of the through-prism, or else inclined relative to one or other of the polygonal bases of the through-prism. In particular, when the upper and lower surfaces of the plate are parallel to one another, as well as the polygonal bases of the through-prisms, then the axis of the through-prisms can be perpendicular to said upper and lower surfaces of the plate, or else can be inclined relative to said upper and lower surfaces of the plate.

Preferably, the main lower and upper surfaces are parallel to one another, the axis of the prisms is perpendicular to the main surfaces and the base of the prisms is the cross-section of the prisms.

In this case, the prisms or channels are oriented perpendicular to the main surfaces of the screen. The bases of the channels, or prisms, are then their cross-sections.

Preferably, said at least one plate also comprises a through-opening, which is preferably central and for example circular, of size greater than that of the through-prisms, in order to facilitate and accelerate the ignition of the emitter.

In order to increase the performance of the screen, in particular in terms of stability and speed of ignition, said screen can also comprise a through-channel, preferably central, having a base of surface area greater than that of the prisms forming a tiling of the surface of the screen. Such a channel can, for example, be produced by piercing, using a drill bit, said screen in a direction parallel to the prism axes of the screen. Such a piercing then enables some walls of the prisms to be removed, or even one or more complete prisms, in order to form a channel with larger cross-section. Such a channel can, in practice, improve the operation of the screen, and in particular its stability and its warm-up speed.

Preferably, said at least one plate has a degree of opening greater than or equal to 40%, preferably greater than or equal to 50% and more preferably greater than or equal to 60%, and, in use, the emitter has a power greater than or equal to 50 $kW/m^2$, preferably greater than or equal to 100 $kW/m^2$, and more preferably greater than or equal to 200 $kW/m^2$.

The structure according to the disclosure makes it possible to optimise the number of prisms, or channels, in the screen, for a given size of prism and size of screen. It is then possible to obtain particularly high degrees of opening of the screen plate.

The emitter preferably comprises a plurality of screens in the form of at least one plate, said screens in the form of at least one plate being arranged in a plurality of planes parallel to one another, for example two planes parallel to one another, and optionally arranged at a distance from one another.

The term "radiating screen" shall mean, a level of elements such as bars, plates or grids, which extend substantially in the same plane that is substantially parallel to the burner plate, or combustion plate, of the emitter.

The emitter according to the disclosure can thus comprise a plurality of screen levels, with a plurality of screens formed by a plate according to the present disclosure.

The screen preferably comprises at least two plates adjacently mounted in a same plane, said at least two plates being separated, at ambient temperature, by a thermally insulating material or else said at least two plates being mounted with clearance between them in said same plane.

The screen can comprise two or more plates, with juxtaposed prisms tiling at least one portion of the surfaces of the plates. Said two or more plates are arranged in the same plane and are juxtaposed with one another, in the plane of the screen. In particular, the plates can be separated by a thermally insulating material, or may quite simply have a clearance between them in the plane of the screen, in order to be able to expand when the temperature increases, while limiting the risk of deterioration.

Such a configuration can, in particular, be advantageous when the emitter comprises two burner plates mounted side-by-side, for example two ceramic plates. In this case, the screen can include two plates with prisms which are located substantially facing each of the burner plates.

Said plate is preferably made of a thermally conductive material, for example made of metal alloy or of silicon carbide or of silicon carbide infiltrated with silicon or of silicon nitride, or else is made of thermally insulating ceramic, for example of cordierite or alumina, coated with a thermal conductor, for example silicon carbide, or silicon carbide infiltrated with silicon, or silicon nitride.

Such materials make it possible to obtain the desired performance in terms of infrared radiation, but also in terms of temperature resistance and in terms of lifespan.

The emitter preferably comprises a burner plate, said burner plate acting as combustion surface, said screen in the form of at least one plate being positioned on the combustion-surface side of said burner plate.

The emitter also preferably comprises one or more additional screens, for example formed of bars or a metal grid, in particular woven, arranged in one or more planes parallel to the plane of said screen in the form of at least one plate, and optionally arranged at a distance from said screen in the form of at least one plate.

Such conventional screens can be added to the emitter, in addition to the screen having a plate with prisms. Such screens are then positioned in one, or more, planes parallel to the screen having a plate with prisms, and able to complement the performance of the screen having a plate with prisms.

The screen is preferably at a distance from the burner plate of, for example, at least 1 mm, and preferably at least 2 mm.

Each prism preferably has a form factor, for example a ratio of the dimension along the axis over the largest dimension of the base, greater than 3, preferably greater than 10 and more preferably greater than 30.

Such a high aspect ratio thus translates into a dimension of the prisms along their axis, which is larger, or even much larger, than the largest dimension of the base. This is manifest, in particular, by a thicker screen than that of the prior art, or else, with a similar thickness but smaller channels, and therefore more numerous channels. Such a high aspect ratio makes it possible, in particular, to have a screen with more material. Such a screen can thus increase the heat transfer between the lower main surface and the upper main surface, by thermal conduction through the material of the screen, which improves the efficiency.

BRIEF DESCRIPTION OF THE FIGURES

FIG. 1 is a partial section, in perspective, of an infrared radiation emitter with a screen according to the prior art;

FIG. 2 is a schematic representation, in perspective, of a first embodiment of the screen according to the disclosure for an infrared radiation emitter;

FIG. 3 is a schematic representation of a cross-section of an infrared radiation emitter equipped with the screen shown in FIG. 2, FIG. 4 is a schematic representation, in perspective, of a second embodiment of the screen according to the disclosure for an infrared radiation emitter.

DESCRIPTION OF THE EMBODIMENTS

FIG. 1 shows a gas-heated infrared radiation emitter 1 including a screen 2 according to the prior art, for example in the form of a metal grid or braided metal wires.

The emitter 1 includes a frame 4 with a supply inlet 6 for the gases to be burnt, and a burner plate 8 arranged facing the inner surface of the screen 2. The frame 4 and the burner plate 8 define an inner chamber into which the gases are conveyed entering via the supply inlet 6.

The burner plate 8 may be, for example, a perforated ceramic plate, the perforations of which are intended to allow gases present in the inner chamber of the emitter 1 to leave. On leaving the perforations, the gases are then burned on the outer surface 10, or combustion surface of the burner plate 8 when there is a flame, and then heat the screen 2 arranged facing the outer surface 10.

In particular, as illustrated in FIG. 1, the burner plate 8 may comprise a crenelated or ribbed outer surface 10. Hence, the burner plate 8 can have, on the outer surface 10, various levels of combustion surface, for example two. The outer surface 10 can, for example, comprise parallel ribs arranged obliquely over the entire surface of the burner plate 8.

Such burner plates 8 with a plurality of levels of combustion surface are described, in particular, in document WO 2010/003904.

FIG. 2 schematically illustrates the general form of a screen 12 according to the present disclosure. The screen 12 is formed by a plate 14 formed by the juxtaposition of through-channels, or prisms 16, and having a lower main surface 18 and an upper main surface 20 (see FIG. 3) which are parallel in the present case. The plate 14 of the screen 12 may comprise, in particular, a thermally conductive material, for example a metal alloy or silicon carbide. Alternatively, the plate 14 may comprise a thermally insulating ceramic, for example cordierite or alumina, coated with a thermally conductive material, such as silicon carbide.

More precisely, the plate 14 of the screen 12 includes a plurality of through-channels 16, the through-channels extending from the lower main surface 18 to the upper main surface 20. The through-channels 16 having a prism geometry defined by a polygonal base and by an axis, in other words a geometry delimited, in space, by a lower polygonal base, an upper polygonal base at a distance from the lower polygonal base, and side walls connecting the sides of the polygonal bases to one another. In particular, the polygonal bases of the various prisms form a tiling of at least one portion of the main upper and lower surfaces of the plate 14.

As illustrated in FIG. 2, the channels 16 of the plate 14 are identical and with hexagonal base, and extend perpendicular to the main upper 20 and lower 18 surfaces. In other words, the channels 16 extend along an axis perpendicular to the upper 20 and lower 18 main surfaces. The channels 16 therefore have a prism geometry defined by a hexagonal base extending in the plane of the main surfaces 18, 20 of the plate 14, and an axis perpendicular to the main surfaces 18, 20. The upper and lower hexagonal bases of the through-channels 16 are thus identical, and the walls connecting the sides of the hexagonal bases are rectangles, optionally identical (see FIG. 3). The through-channels 16 allow the burned gas to circulate at the outer surface 10 of the burner plate 8, but are also heated by these and therefore emit infrared.

The hexagonal base of the through-channels 16 is chosen so as to enable tiling of at least one portion of the upper 20 or lower 18 main surface. A hexagonal base makes it possible to obtain an overall honeycomb structure, in which the prisms are juxtaposed with one another so that their bases cover said portion of the upper 20 or lower 18 main surface. In particular, the side walls of the through-channels 16 are common between two adjacent or neighbouring through-channels 16.

However, the hexagonal base is not the only polygonal base enabling a tiling of at least one portion of the upper 20 or lower 18 main surface. The through-channels 16 can thus have a triangular base, or even a square base, as shown in FIG. 4.

Similarly, it is also possible to envisage through-channels 16 having polygonal bases of the same shape but different sizes. Thus, the size of the polygonal base of the through-channels 16 could vary according to the position with respect to the centre and/or to the ends of the plate 14, while retaining a tiling of at least one portion of the main surface of the plate 14.

Thus, through the use of through-channels 16 that are juxtaposed so that their bases form tiling of at least one portion of the main surface of the plate 14, a particularly high degree of opening of the plate is obtained, while retaining a mechanically stable and durable structure. The plate according to the disclosure can thus have a degree of opening greater than or equal to 40%, and more generally greater than or equal to 60%, or else greater than or equal to 80%. At the same time, the emitter 1 can have a power greater than or equal to 50 $kW/m^2$, preferably 100 kW/m 2, or even 200 $kW/m^2$.

In order to improve the operating stability, the plate 14 can also comprise a through-opening 24 of size greater than that of the through-channels 16. The through-opening 24 can improve the operation of the emitter, in particular at ignition.

The through-opening 24 can be produced, in particular, by piercing the plate 24, for example using a drill bit, leading to the removal of some of the walls of the channels 16. An opening 24 can then be obtained that is larger than the channels 16. The through-opening 24 is preferably produced at the centre of the plate 14.

FIG. 3 shows a section through the screen 12 shown schematically in FIG. 2. As can be seen in FIG. 3, the axis of the channels 16 of the screen 12 is oriented in the direction of circulation of the burned gases, in other words from the outer surface of the burner plate 8 to the upper main surface 20 of the screen 12.

In FIG. 3, the emitter 1 includes only a single screen 12, and the screen 12 includes only a single plate 14. However, the screen could likewise comprise a plurality of plates 14 arranged in a same plane, one beside the other, for example two adjacent plates 14, or else four plates 14 arranged in a square. Such an embodiment makes it possible, in particular, to obtain large surface-area screens, even when the plates 14 can only be manufactured with small dimensions. Such an embodiment may also be preferred when the emitter 1 includes a plurality of coplanar combustion plates 8. In this case, each plate 14 of the screen 12 can be positioned facing one and only one burner plate 8.

In order to limit the risks of deterioration connected to thermal expansion and/or thermal shocks, separations, made of thermally insulating material for example, can be provided between the plates 14 of the screen 12, or else clearance can be provided between the plates 14 in order to leave a little freedom between the plates 14 and between them and the peripheral contour of the screen 14.

When the screen includes a plurality of coplanar plates 14, the through-channels 16 of the various plates can be of different size or shape, for example some with square base and others with hexagonal base, or else oriented in different directions, for example in the case of triangular based channels.

Similarly, the through-opening 24 of each plate 14 need not be centred with respect to the plate 14 but, by contrast, may be positioned in a central zone of the screen 12.

Finally, the emitter 1 may also comprise a plurality of screens, in other words a plurality of levels parallel to one another and parallel to the burner plate 8, that can be heated and emit infrared. Thus, the various screens may all comprise one or more plates 14 with channels 16 according to the present disclosure. In particular, the geometry of the through-channels 16 and/or their size can vary between the various screens, according to the distance separating the screen from the burner plate 8. Alternatively, the emitter 1 can comprise at least one screen with one or more plates 14 having channels 16 according to the present disclosure, in combination with screens of the prior art.

FIG. 4 shows a second embodiment of the disclosure. More precisely, FIG. 4 shows a screen 12' in which the through-channels 16' are prisms having a square polygonal base.

As shown in FIG. 4, the screen 12' according to the second embodiment of the disclosure does not have a plate 14 with a honeycomb structure, but with a grid structure. However, the dimensions of the different channels 16' remain identical to one another, even though it is possible to provide channels with different sizes; twice as large, for example.

As in the case of the first embodiment, a through-opening 24 can be provided, in particular at the centre of the plate 14'.

Thus, the specific structure of the screen according to the present disclosure makes it possible to obtain operating properties, in particular at start-up of the emitter, which are better than those of emitters from the prior art, while retaining an inexpensive screen that is reliable over time.

The invention claimed is:

1. A gas-heated infrared radiation emitter comprising at least one radiating screen in the form of at least one plate comprising:

a lower main surface and an upper main surface that are distant from each other, a plurality of through-prisms extending from the lower main surface to the upper main surface, each through-prism of the plurality of through-prisms being defined by a polygonal base and by an axis, and a burner plate, said burner plate acting as combustion surface, said screen in the form of at least one plate being positioned on the combustion surface side of said burner plate, wherein the plurality of through-prisms are juxtaposed with one another so that their polygonal bases form a tiling of at least one portion of the lower and upper main surfaces of said plate, wherein each through-prism of the plurality of through-prisms has a form factor greater than 3, and wherein said plate comprises silicon carbide infiltrated with silicon.

2. The emitter according to claim 1, wherein the through-prism bases are all hexagonal, triangular or square.

3. The emitter according to claim 1, wherein the lower and upper main surfaces are parallel to one another, wherein the axis is perpendicular to the main surfaces and wherein the base of the prisms is the cross-section of the prisms.

4. The emitter according to claim 1, wherein said at least one plate also comprises a through-opening of size greater than that of the through-prisms, in order to facilitate and accelerate the ignition of the emitter.

5. The emitter according to claim 1, wherein said at least one plate has a degree of opening greater than or equal to 40%.

6. The emitter according to claim 1, comprising a plurality of screens in the form of at least one plate, said screens in the form of at least one plate being arranged in a plurality of planes parallel to one another.

7. The emitter according to claim 1, wherein the screen comprises at least two plates adjacently mounted in a same plane, said at least two plates being separated, at ambient temperature, by a thermally insulating material or else said at least two plates being mounted with clearance between them in said same plane.

8. The emitter according to claim 1, wherein said plate is made of silicon carbide infiltrated with silicon or is made of thermally insulating ceramic coated with silicon carbide infiltrated with silicon.

9. The emitter according to claim 1, also comprising one or more additional screens arranged in one or more planes parallel to the plane of said screen in the form of at least one plate.

10. The emitter according to claim 1, wherein each prism has a form factor greater than 10.

11. The emitter according to claim 1, wherein the at least one radiating screen is made of ceramic and/or metal.

12. The emitter according to claim 2, wherein the through-prism bases are all identical.

13. The emitter according to claim 4, wherein the through-opening of said at least one plate is central.

14. The emitter according to claim 4, wherein the through-opening of said at least one plate is circular.

15. The emitter according to claim 6, wherein said screens are arranged in two planes parallel to one another.

16. The emitter according to claim 6, wherein said screens are arranged at a distance from one another.

17. The emitter according to claim 9, wherein said one or more additional screens are arranged at a distance from said screen in the form of at least one plate.

18. The emitter according to claim 1, wherein each prism has a ratio of a dimension along the axis over the largest dimension of the base, greater than 3.

19. A gas-heated infrared radiation emitter comprising at least one radiating screen in the form of at least one plate comprising:

a lower main surface and an upper main surface that are distant from each other, a plurality of through-prisms extending from the lower main surface to the upper main surface, each through-prism of the plurality of through-prisms being defined by a polygonal base and by an axis, and a burner plate, said burner plate acting as combustion surface, said screen in the form of at least one plate being positioned on the combustion surface side of said burner plate, wherein the plurality of through-prisms are juxtaposed with one another so that their polygonal bases form a tiling of at least one portion of the lower and upper main surfaces of said plate.

20. The gas-heated infrared radiation emitter of claim 19, wherein each through-prism of the plurality of through-prisms has a form factor greater than 3.

* * * * *